US005752399A

United States Patent [19]

Shen

[11] Patent Number: 5,752,399

[45] Date of Patent: May 19, 1998

[54] DOOR HANDLE ASSEMBLY WITH REVERSIBLE CORE RETAINER

[76] Inventor: Mu-Lin Shen, No. 32, Lane 76, Sec. 5, Fu-an Rd., Tainan, Taiwan

[21] Appl. No.: 854,427

[22] Filed: May 12, 1997

[51] Int. Cl.[6] ..... E05B 13/10

[52] U.S. Cl. ..... 70/224; 70/369; 70/371; 70/462; 292/348

[58] Field of Search ..... 70/367–371, 224, 70/DIG. 39, DIG. 31, 462; 292/348–355

[56] References Cited

U.S. PATENT DOCUMENTS

| | | | |
|---|---|---|---|
| 3,149,871 | 9/1964 | Russell et al. | 70/224 |
| 3,308,641 | 3/1967 | Russell et al. | 70/224 |
| 3,413,829 | 12/1968 | Russell | 70/224 |
| 4,435,967 | 3/1984 | Best et al. | 70/224 |
| 4,995,249 | 2/1991 | Preissler et al. | 70/224 |
| 5,398,531 | 3/1995 | Shen | 70/224 |

*Primary Examiner*—Lloyd A. Gall

*Attorney, Agent, or Firm*—Heller Ehrman White and McAuliffe

[57] ABSTRACT

A door-handle assembly comprising a rotatable spindle, a core retainer, a knob and an interchangeable lock core. The spindle and the retainer are so designed that the retainer is selectably oriented either upwardly or downwardly with respect to the spindle. The knob and therefore the lock core are then inverted in view of the invertable retainer so that a key for manipulating the lock core is used with its key cuts similarly either upwardly or downwardly oriented during use.

3 Claims, 6 Drawing Sheets

DOOR HANDLE ASSEMBLY WITH REVERSIBLE CORE RETAINER

BACKGROUND OF THE INVENTION

The present invention relates to a door lock assembly with a key-operated interchangeable lock core supported in a hollow doorknob by means of a core retainer or cap and, in particular, to a door handle assembly of which the interchangeable lock core is invertable so that the key for operating the lock core can be accommodated to either one of two orientations according to different door handings.

Key-operated door locks with hollow knobs are known to have types of right handing and left handing. If a key-operated door lock is to be so installed that a change of handing is involved, then the orientation for insertion of a key will be inverted. For door locks having long handles, the orientation for insertion of a key can be certain in the aspect that key cuts on the key will always be directed toward a direction in conformity with that along which the handle extends. However, with a key-operated door lock installed, it is generally not certain with what orientation an associated key should adopt in order to normally unlock the lock.

As far as door locks with hollow knobs are concerned, many people may have the experience of repeated trial of inserting an authentic key into the lock core, but only to find that they simply cannot insert the key into the lock core. In the case that both the lock core and the key are proper, i.e., without any defect, the above situation is most likely due to wrong orientation of the key during inserting. Alternatively, being unsure of the correct orientation of the key for inserting, it will be difficult for one to correctly insert the key into the lock core.

Moreover, a user might miss the correct insertion if an initial insertion with a correct orientation of the key does not go smoothly. This is particularly so in a dark environment.

U.S. Pat. No. 3,308,641 issued to F. J. Russell et al. on Mar 14, 1967 discloses a lock comprising a cap for retaining a removable core. The cap is constructed with a first flange and a second flange, which define a pocket therebetween, for engaging with a spindle. Should it be desired to invert the position of the interchangeable lock core, the cap with related components can be rotated 180 degrees to accommodate this change of orientation. The cap within the lock is anchored against rotational movement by the removable core. When the removable core is removed to be replaced, the cap might turn to thereby result in "core trapping" due to lack of anchorage.

U.S. Pat. No. 5,398,531 issued to Shen on Mar. 21, 1995 discloses a rotational housing assembly for a lock assembly with a removable core. The assembly comprises a core retainer and a spindle which are both separate from a handle housing so as to provide a simple structure for ease of manufacture.

The present invention aims to provide an improved door handle assembly equipped with a key-operated interchangeable lock core supported in a hollow doorknob through a core retainer.

BRIEF SUMMARY OF THE INVENTION

A primary object of the present invention is to provide a door handle assembly comprising: a rotatable spindle having a pair of slots disposed diametrically opposite to each other; a core retainer having a front flange abutting an end face of the rotatable spindle, a slot selectably aligned with one of the pair of slots of the rotatable spindle, a stop fittingly received in the other of the pair of slots of the rotatable spindle, and a rear end face; a knob for drivingly turning the rotatable spindle, the knob having a grip portion and a tubular shank telescopingly receiving the rotatable spindle, the grip portion having an opening; and an interchangeable lock core accommodated in the opening of the knob grip portion and having a control lug operable to project and be blocked by the end face of the core retainer from an outward movement.

With this arrangement, a simple while reliable door handle assembly which permits end users to manipulate a key with its key cuts always facing either an upward direction or a downward direction is provided.

Other objects, advantages and novel features of the invention will become more apparent from the following detailed description when taken in conjunction with the accompanying drawings.

BRIEF DESCRIPTION OF THE SEVERAL VIEWS OF THE DRAWING

FIG. 6A is a schematic exploded view of the door handle assembly corresponding to the arrangement of FIG. 6, together with a key.

DETAILED DESCRIPTION OF THE INVENTION

Figure 1:
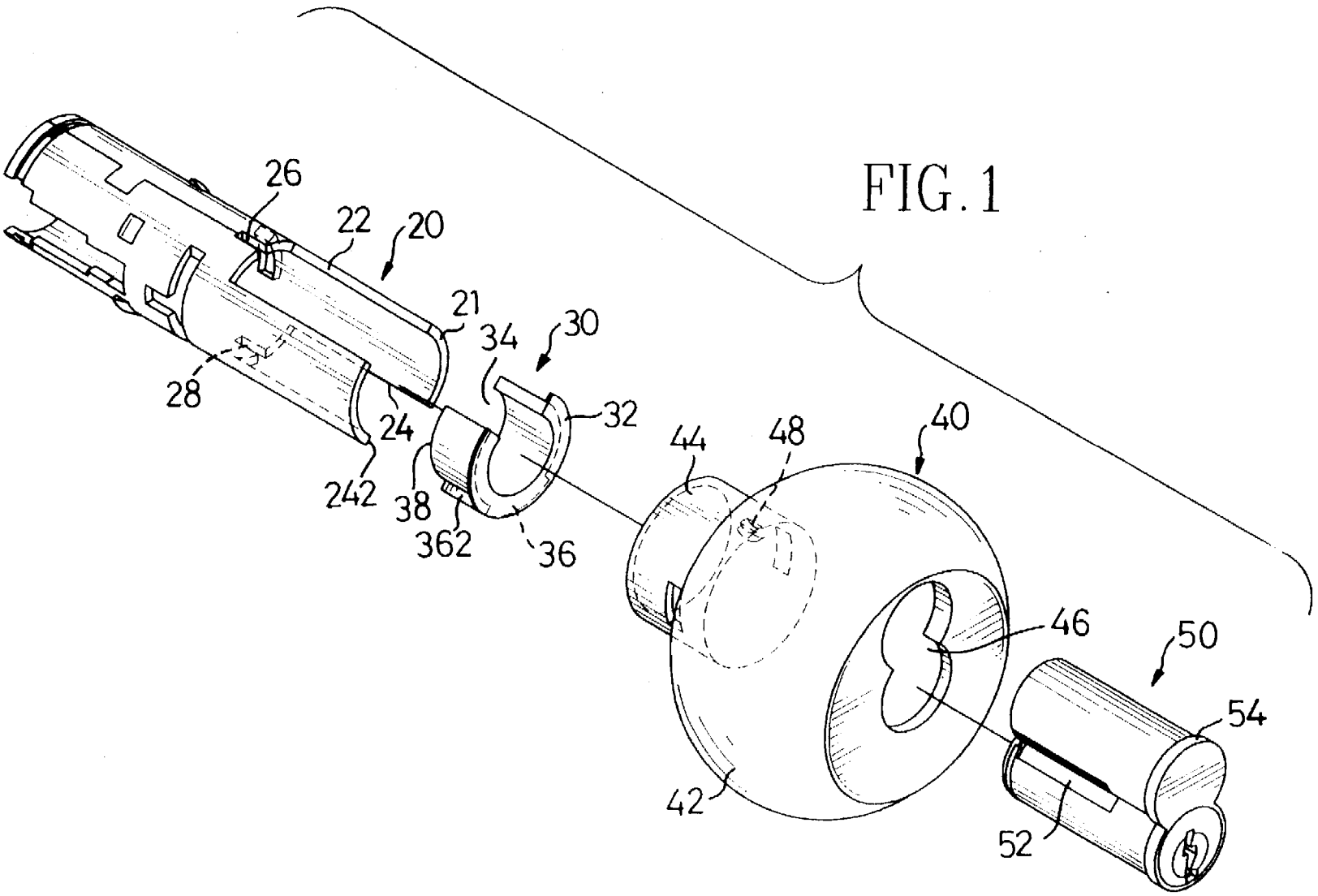
FIG. 1 is a perspective exploded view of a door handle assembly in accordance with the present invention.
Figure 2:
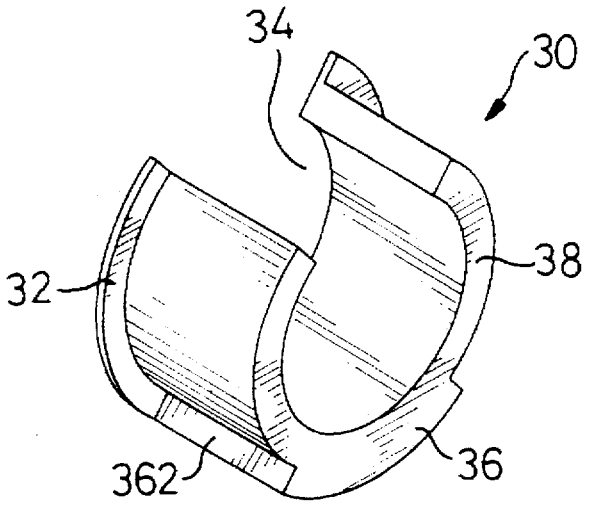
FIG. 2 is a perspective view, in an enlarged scale, of a core retainer in accordance with the present invention.
Figure 4:
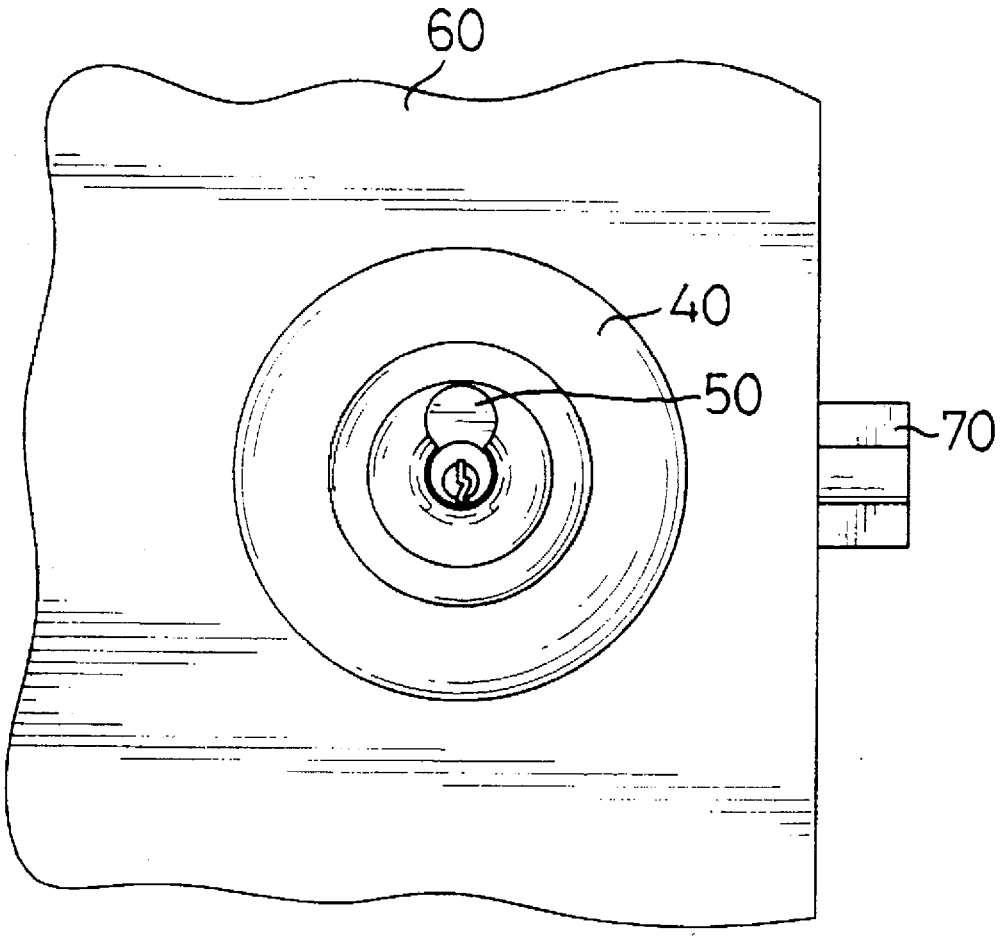
FIG. 4 is a schematic view showing the assembly of the invention mounted to a door under a left handing.
Figure 5:
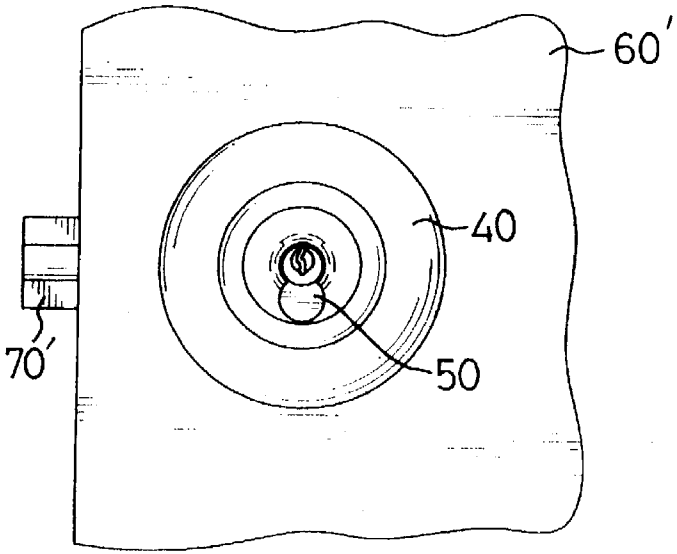
FIG. 5 is a schematic view showing the assembly of the invention mounted to a door under a right handing.

FIG. 1 shows a door handle assembly, in exploded view, which comprises a rotatable spindle 20, a core retainer 30, a knob 40 and an interchangeable lock core 50. As the door handle assembly is mounted to a door 60 as schematically shown in FIG. 4, it will occupy a certain configuration as can be seen from the protruding direction of a latch bolt 70 with respect to the door 60 as well as from the orientation of the interchangeable lock core 50 which requires a key (not shown) to be inserted with its key cuts facing upward (as view in the direction of FIG. 4) in order to retract the latch bolt 70 and therefore unlock the door. When the same door handle assembly is applied to a different door 60' such as shown in FIG. 5, where the latch bolt 70' protrudes leftward (as view in the direction of FIG. 5), the door handle assembly is simply inverted, just like rotating the assembly together with the door 180 degrees, so that the key (not shown) used to unlock the door has to be inserted with its key cuts facing downward instead of upward due to the lock core being inverted. The present invention provides an improved construction for allowing the interchangeable lock core to be inverted so that a key used to unlock a door needs not be inverted due to different handing of door to which the door handle assembly is mounted. According to the present invention, this is achieved by inverting the core retainer 30, the knob 40 and the interchangeable lock core 50. This will be apparent from a comparison of FIG. 5A and FIG. 6A which correspond to FIG. 5 and FIG. 6, respectively, and will be described later.

Referring now to FIGS. 1–3 and FIG. 7, the spindle 20 is generally of a known structure and is rotatably mounted to for example a hub (not shown) on which the door lock assembly is supported. The spindle 20 has a pair of slots 22 and 24 disposed diametrically opposite to each other. The core retainer 30 is generally of a cylindrical shape and has a front flange 32 extending laterally from the cylindrical body. A slot 34 is cut through the body and a stop 36 projects from the body. When the retainer 30 is mounted onto the spindle 20, the front flange 32 abuts an end face 21 of the rotatable spindle 20, the slot 34 aligns, in the embodiment shown, with the slot 22 of the rotatable spindle 20 and the stop 36 is fittingly received in the slot 24 of the rotatable spindle 20. The stop 36 is fitted to the slot 24 in such a manner that two opposed side faces 362 of the stop 36 approximately contact two opposed walls 242 defining the slot 24. A rear end face 38 is defined on the body of the retainer 30.

The knob 40 is used for drivingly turning the rotatable spindle 20, as is known in this art. The knob 40 has a grip portion 42 and a tubular shank 44 fixedly connected with the grip portion 42. The tubular shank 44 telescopingly receives the rotatable spindle 20 and the retainer 30 mounted to the spindle 20 in such a manner that a knob keeper (not shown) can be normally biased in a radial outward direction for example by a spring (not shown) to secure the shank 44 to the spindle 20 in the usual way. The grip portion 42 has an opening 46 for accommodation of the lock core 50.

Figure 3:
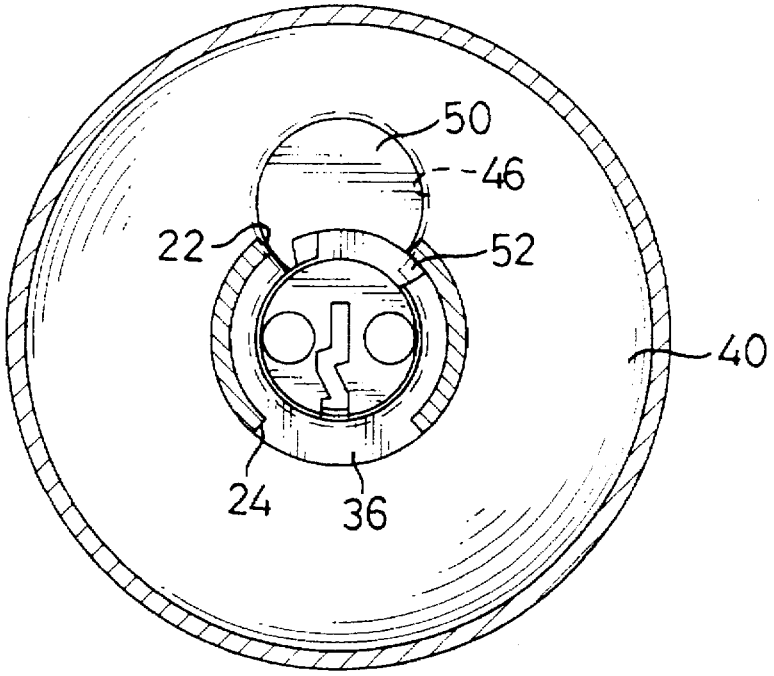
FIG. 3 is a plan view showing interconnection of an interchangeable lock core with a rear end of the core retainer.

The interchangeable lock core 50 accommodated in the opening 46 of the knob grip portion 42 is generally of a known design which has a control lug 52 operable to project therefrom. As shown in FIG. 3, the projected control lug 52 is blocked by the end face 38 of the core retainer 30 so that the lock core 50 is prevented from an outward movement, as clearly shown in FIG. 3. A further inward movement of the lock core 50 may be prevented in a known manner such as by forming an enlarged front end 54 (see FIG. 1) to rest against the flange 32 of the retainer 30.

In accordance with a feature of the invention, the rotatable spindle 20 may have a pair of positioning slots 26 and 28 each in communication with an adjacent one of the pair of slots 22 and 24 and being diametrically opposite to each other. The tubular shank 44 then has a tab 48 received, through the slot 34 of the core retainer 30, into a corresponding slot 26 of the rotatable spindle 20.

Figure 5A:
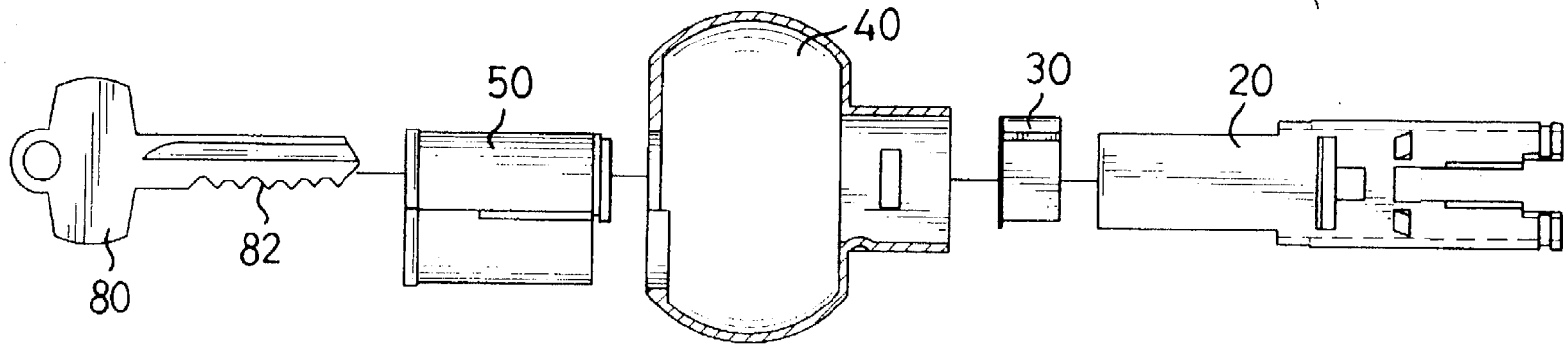
Figure 6:
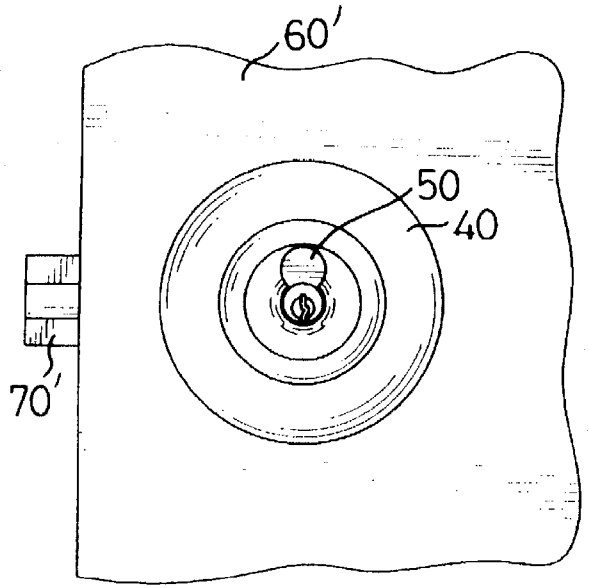
FIG. 6 is a view similar to FIG. 5 but showing the interchangeable lock core inverted.
Figure 6A:
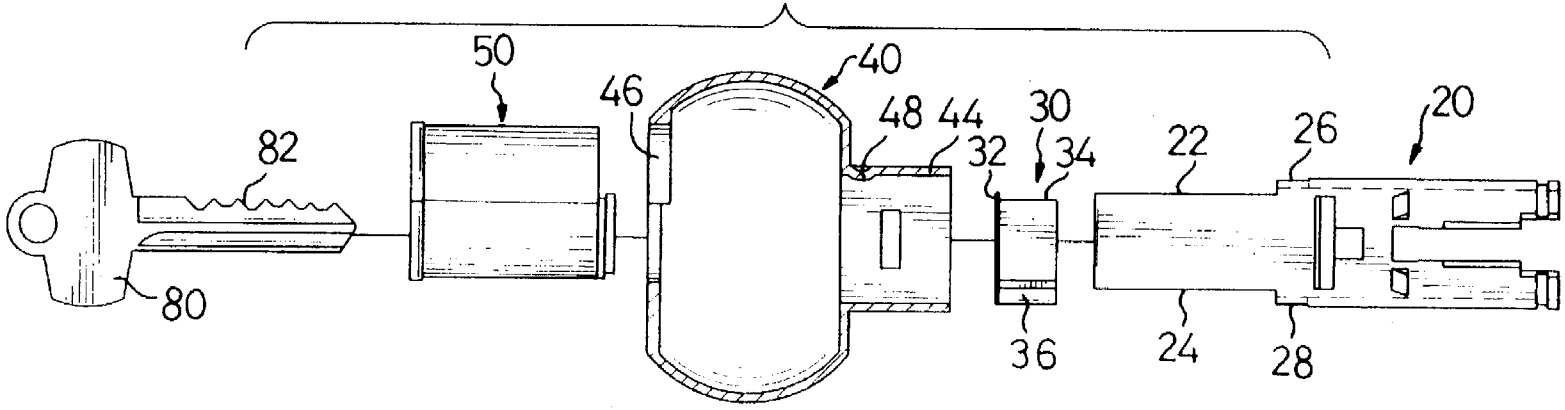
FIG. 6A is a schematic exploded view of the door handle assembly corresponding to the mounting of FIG. 5, together with a key.
Figure 7:
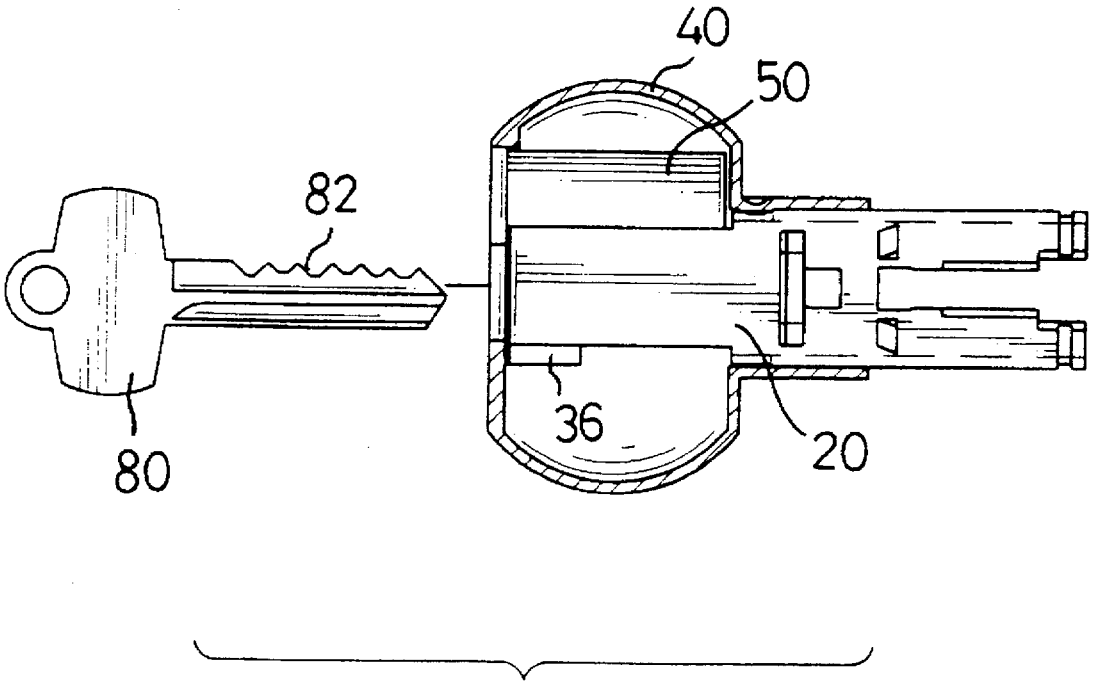
FIG. 7 is a partly cross-sectional, assembled view of the door handle assembly having same arrangement and orientation as FIG. 6A, together with a key.

As previously mentioned, the elements shown in FIG. 5A differ from the elements shown in FIG. 6A only in that the orientation of each of the core retainer 30, the knob 40 and the interchangeable lock core 50 is inverted, with a result that key cuts 82 of a key 80 are changed from downwardly directing (FIG. 5A) to upwardly directing (FIG. 6A). By providing a rotatable spindle 20 which has the pair of slots 22 and 24 diametrically disposed and a core retainer 30 which has the slot 34 and the stop 36, the retainer 30 is always attached to the spindle 20 in such a manner as to, on the one hand, afford a passage for the lock core 50 to enter and, on the other hand, reinforce one of the slots 22 and 24 in order that the spindle 20 will not be weakened due to presence of long and wide slots 22 and 24. Once the retainer 30 can be inverted, the knob 40 and therefore the lock core 50 can also be inverted without problem.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A door handle assembly comprising:

a rotatable spindle having a pair of slots disposed diametrically opposite to each other;

a core retainer having a front flange abutting an end face of the rotatable spindle, a slot aligned with a selected one of the pair of slots of the rotatable spindle, a stop fittingly received in the other one of the pair of slots of the rotatable spindle, and a rear end face;

a knob for drivingly turning the rotatable spindle, the knob having a grip portion and a tubular shank telescopingly receiving the rotatable spindle, the grip portion having an opening; and an interchangeable lock core accommodated in the opening of the knob grip portion and in the core retainer slots and having a control lug operable to project and be blocked by the rear end face of the core retainer from an outward movement.

2. The door handle assembly as claimed in claim 1, wherein the slot of the retainer and the selected slot of the rotatable spindle together provide a passage for the lock core to enter and the stop of the core retainer reinforces the other slot of the rotatable spindle.

3. The door handle assembly as claimed in claim 1, wherein;

the rotatable spindle has a pair of positioning slots each in communication with one of the pair of slots and being diametrically opposite to each other; and the tubular shank has a tab received, through the slot of the core retainer, into one of the pair of positioning slots of the rotatable spindle.

* * * * *